US006502627B2

(12) United States Patent
Frank et al.

(10) Patent No.: US 6,502,627 B2
(45) **Date of Patent: *Jan. 7, 2003**

(54) CONTROLLABLE VARIABLE MAGNETIC FIELD APPARATUS FOR FLOW CONTROL OF MOLTEN STEEL IN A CASTING MOLD

(75) Inventors: William R. Frank, Coraopolis, PA (US); Jonathan Dorricott, Aurora, IL (US)

(73) Assignee: Ipsco Enterprises Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/955,579

(22) Filed: Sep. 17, 2001

(65) Prior Publication Data

US 2002/0074103 A1 Jun. 20, 2002

Related U.S. Application Data

(63) Continuation of application No. 09/404,902, filed on Sep. 24, 1999, now Pat. No. 6,341,642, which is a continuation-in-part of application No. 09/108,466, filed on Jul. 1, 1998, now Pat. No. 6,006,822.

(60) Provisional application No. 60/051,422, filed on Jul. 1, 1997.

(51) Int. Cl.[7] ..... B22D 11/00; B22D 27/02

(52) U.S. Cl. ..... 164/502; 164/466

(58) Field of Search ..... 164/466, 468, 164/502, 504

(56) References Cited

U.S. PATENT DOCUMENTS

| | | | |
|---|---|---|---|
| 4,139,047 | A | 2/1979 | Parrish |
| 4,150,712 | A | 4/1979 | Dussart |
| 4,164,974 | A | 8/1979 | Ruer et al. |
| 4,239,078 | A | 12/1980 | Tarmann |
| 4,244,419 | A | 1/1981 | Von Starck et al. |
| 4,244,420 | A | 1/1981 | Dain |
| 4,289,946 | A | 9/1981 | Yarwood et al. |
| 4,353,407 | A | 10/1982 | Bostedt |
| 4,424,856 | A | 1/1984 | Onoda et al. |
| 4,506,725 | A | 3/1985 | Bedell |
| 4,567,937 | A | 2/1986 | Ujiie et al. |
| 4,579,167 | A | 4/1986 | Kuznetsov |
| 4,601,327 | A | 7/1986 | Kaneko et al. |
| 4,824,078 | A | 4/1989 | Szekely et al. |

(List continued on next page.)

FOREIGN PATENT DOCUMENTS

| | | | |
|---|---|---|---|
| DE | 2853049 | | 6/1979 |
| JP | 63-188461 | * | 8/1988 |
| JP | 4-71759 | | 3/1992 |
| JP | 5-77007 | | 3/1993 |
| JP | 5-96351 | | 4/1993 |
| JP | 5-154620 | | 6/1993 |
| JP | 5-154621 | | 6/1993 |
| JP | 5-154623 | | 6/1993 |

*Primary Examiner*—Kuang Y. Lin
(74) *Attorney, Agent, or Firm*—Brinks Hofer Gilson & Lione

(57) ABSTRACT

An apparatus for providing a magnetic field in a casting mold to slow and redirect in a controllable fashion the flow of liquid steel exiting from a submerged entry nozzle into the casting mold uses selectable removable ferromagnetic and non-magnetic laminar elements stackable on the ends of core fingers in the vicinity of the poles of an electromagnetic yoke positioned adjacent the mold face. By selecting the type and location of the stackable elements on the ends of the fingers, one can modify the properties of the magnetic field permeating the interior of the mold. Optionally, independent field coils may be provided for energizing selected portions of the magnetic field core structure to provide further magnetic field control without having to remove and replace laminar elements.

15 Claims, 6 Drawing Sheets

U.S. PATENT DOCUMENTS 4,848,441 A 7/1989 Meyer
4,865,116 A 9/1989 Peterson et al.
4,986,339 A 1/1991 Miyazawa
4,987,951 A 1/1991 Dietrich et al.
5,033,534 A 7/1991 Suzuki et al.
5,137,077 A 8/1992 Sawada
5,238,051 A * 8/1993 Kikuchi et al. ..... 164/466
5,265,665 A 11/1993 Fujii et al.
5,332,027 A 7/1994 Kageyama et al.
5,375,647 A 12/1994 Fang et al.
5,381,857 A * 1/1995 Tozawa et al. ..... 164/466
5,404,933 A 4/1995 Andersson et al.
5,424,703 A 6/1995 Blume, Jr.
5,570,736 A 11/1996 Nara
5,613,548 A * 3/1997 Streubel et al. ..... 164/466
5,632,324 A 5/1997 Nara et al.
5,657,816 A 8/1997 Harada et al.
5,664,619 A 9/1997 Andersson et al.
5,986,379 A 11/1999 Hollenbeck et al.
5,988,261 A 11/1999 Milorad et al.
6,003,590 A 12/1999 Pavlicevic et al.
6,026,113 A 2/2000 Pavlicevic et al.
6,064,552 A 5/2000 Iwasaki et al.
6,164,365 A 12/2000 Kunstreich et al.

* cited by examiner

CONTROLLABLE VARIABLE MAGNETIC FIELD APPARATUS FOR FLOW CONTROL OF MOLTEN STEEL IN A CASTING MOLD

CROSS-REFERENCE TO RELATED APPLICATIONS

This application is a continuation application Ser. No. 09/404,902, filed Sep. 24, 1999, now U.S. Pat. No. 6,341,642, which is a continuation-in-part of application Ser. No. 09/108,466 filed Jul. 1, 1998, now U.S. Pat. No. 6,006,822, which claims the benefit of provisional application No. 06/051,422, filed Jul. 1, 1997, the entirety of each of these applications is hereby incorporated by reference herein.

FIELD OF THE INVENTION

The present invention relates to a magnetic field apparatus for controlling the flow of molten steel in a casting mold, and more particularly to an apparatus for providing an adjustable magnetic field in a casting mold to impede and redirect in a controllable fashion the flow of liquid steel exiting from a submerged entry nozzle that discharges into the casting mold.

BACKGROUND

It is known in the art of steelmaking to continuously cast molten steel using an oscillating mold, typically a water-cooled copper-faced mold having a straight or curved channel. The mold typically has a rectangular horizontal cross-sectional forming conduit as thick and wide as the slab to be cast. Liquid steel in the upper portion of the mold is cooled as it moves downward through the water cooled mold, generating a steel shell as it passes through the mold before exiting the mold at the bottom. The molten steel enters the mold from a tundish through an entry nozzle submerged in the liquid steel in the mold. The submerged entry nozzle is normally located generally centrally of the mold cross-section, and is provided with opposed exit ports that direct liquid steel generally horizontally outwardly toward the narrow sides of the mold. Some nozzles have a bottom port as well.

The flow of liquid steel out of the submerged entry nozzle varies in direction and velocity due to various external conditions (such as the ferrostatic head of steel above the nozzle, and steel chemistry). This can create disturbances in the steel flow that adversely affect both the surface quality and internal quality of the casting. These disturbances tend to generate undesired temperature imbalances that interfere with uniform solidification of the steel as it passes through the mold and downstream thereof, and also increase the tendency of the steel to incorporate unwanted inclusions from the mold powder/slag/impurities mixture at the meniscus of the liquid steel at the top of the mold. A conventional magnetic brake inhibits these disturbances by reducing the velocity of liquid steel emanating from the submerged entry nozzle, thereby tending to constrict the eddies and prevent them from reaching the end edges of the mold and the upper surface of the pool of liquid steel at the top of the mold.

A conventional magnetic brake includes a magnetic circuit energized by direct or slowly varying electric current passing through windings around an iron core forming part of the magnetic circuit. The magnetic circuit passes through the wide faces of the mold so as to provide a magnetic field through the interior of the mold. Normally, in a conventional magnetic brake, the magnetic circuit passes through the mold about mid-way along the longitudinal length of the mold and overlaps the point of entry of liquid steel into the mold from the submerged entry nozzle, but does not extend up to the top of the liquid steel pool nor down to the bottom of the mold.

Although the magnetic field in a conventional magnetic brake can be varied (by varying the amount of current flowing through the windings around the iron core of the magnetic circuit) there is, nevertheless, typically no fine control over the manner in which the magnetic field is applied. Such fine control would improve the ability to control the flow characteristics of the steel as it exits from the submerged entry nozzle, in the interest of generating uniform solidification of the shell of cast steel emerging from the mold and in the interest of reducing unwanted inclusion and non-uniform surface effects.

Attempts have been made by various prior workers in the field to provide some variation in the magnetic field applied through the mold. Representative such attempts are disclosed, for example, in U.S. Pat. No. 5,404,933, issued Apr. 11, 1995 to Andersson et. al. (the Andersson patent), and U.S. Pat. No. 5,613,548 issued Mar. 25, 1997 to Streubel et. al. (the Streubel patent). The Andersson patent discloses an apparatus for controlling the flow of molten metal by applying a static or periodic low-frequency magnetic field across the area through which the molten metal flows. The Streubel Patent discloses an apparatus that accomplishes a similar result by attaching partial cores to a principal core surrounded by an electrical core, thereby influencing the magnetic field applied.

SUMMARY OF THE INVENTION

The present invention is directed generally to an apparatus for providing a magnetic field in molten steel inside a mold for casting molten steel, which magnetic field can be reconfigured so as to modify the flow characteristics of molten steel exiting from a submerged entry nozzle in the mold both by the use of (1) removable ferromagnetic or non-magnetic laminar elements positioned in the magnetic circuit adjacent the mold face, to accommodate changes in the chemistry and other characteristics of the steel to be cast in the mold, or (2) discrete individually energizable coils in the magnetic circuit during the casting of molten steel, in response to changing conditions in the molten steel, or both. It is contemplated that a suitable selection of ferromagnetic and non-magnetic laminar elements in a matrix array immediately adjacent the mold face will accommodate the more major and persistent changes in steel characteristics (e.g., steel chemistry), while the use of the individually engergizable coils (which may also be arranged in a matrix array adjacent the array of laminar elements) is intended to accommodate transient variations in the characteristics of the molten steel (e.g., ferrostatic head).

In the aspect of the present invention directed to providing a magnetic field that may be reconfigured between casting runs, there is provided a pair of magnetic poles comprising at least a pair of magnetic field cores, each core being energized by at least one discrete coil located in the vicinity of a discrete opposed wide face of the mold. The cores are connected by a yoke so that the cores and the yoke together with the mold containing molten steel form a complete magnetic circuit. When the coils are energized, the magnetic field extends generally horizontally from one wide face of the mold to the other. Each magnetic field core has one or more horizontal rows of generally horizontally disposed closely packed "fingers" in proximity to the proximate wide face of the casting mold. (The term "fingers" is used herein to identify a physically discrete projecting portion of the core adjacent the mold face, but it is to be understood that spaces between fingers is undesirable, although frequently necessary because of the need to accommodate opposed projections such as strengthening ribs on the surface of the mold.) The fingers protrude from the ends of their respective cores in two parallel, generally symmetrical generally horizontal arrays, each array abutting a respective face of the mold. (While the benefit of the invention as contemplated by the inventor is best obtained by having two generally identical matching arrays of fingers, one on either side of the mold, there may be circumstances in which the arrays are chosen not to be identical, or the fingers are provided on one side of the mold only.) The individual fingers in each array may abut one another, or some fingers may be slightly spaced apart so as to avoid interfering with other structural elements in the vicinity of the mold faces.

The fingers are comprised of removable ferromagnetic laminar elements and optionally spacers or non-magnetic laminar elements. These laminar elements for each finger are arrangeable in a vertically stacked array extending into proximity with the proximate wide mold face at a selected location. For continuity of the magnetic circuit, each finger should be positioned as close as possible to the adjacent mold face. The local magnetic field in the molten steel in the casting mold near each finger (each selected location) may be varied independently of the local magnetic field in the molten steel in the casting mold near the other selected locations by the addition or removal (effected between casting runs) of ferromagnetic or non-magnetic laminar elements to or from selected fingers, so as to modify flow characteristics of molten steel exiting from the submerged entry nozzle into the casting mold during casting runs. As it is desirable to have a generally uniform magnetic field across the entire transverse width of the array of fingers, fingers near the center of the array may have fewer ferromagnetic laminar elements attached than do fingers at the periphery of the array, to compensate for the natural tendency of the magnetic field to be stronger in the center. It may also be desirable to substitute non-magnetic laminar elements for ferromagnetic laminar elements in portions of the central fingers, or to provide spacers between selected successive ferromagnetic laminar elements, thereby creating air gaps in the magnetic field that serve essentially the same function as non-magnetic laminar elements.

To increase the degree of control of the magnetic field in the vertical direction, more than one horizontal array of fingers may be provided on each side of the mold face, or the capacity of each finger to accept laminar elements may be increased so that the vertical span of each finger is increased. If the first alternative is selected, additional rows of generally horizontally disposed closely packed fingers may be stacked vertically, creating a two-dimensional matrix of fingers, the amount and position of magnetic material in each finger being determined by selectively stacking ferromagnetic and nonmagnetic laminar elements. It may be desirable to provide an increased capacity to apply a magnetic field over the vertical dimension, such as by increasing the number of energizing coils and arranging them in a corresponding two-dimensional matrix, so as to accommodate any changes in the magnetic field distribution that the operator wishes to make.

Another aspect of the present invention is the provision of a magnetic field that may be reconfigured during casting. In this aspect, the magnetic field is created by a number of opposed pairs of magnetic field cores, each of which cores is energized by a discrete energizing coil. One core in each pair is located on one side of the wide face of the mold and its mating core on the other side of the mold directly opposite the first core. The terminal faces of each pair of opposed cores comprise poles of a component magnetic circuit, the overall magnetic circuit for the electromagnetic brake comprising the total of the component magnetic circuits. Each core is coupled within the magnetic circuit by an encircling yoke made from a magnetic material. A discrete individually controllable electrical current may be passed through each coil. When the mold contains molten steel, a composite magnetic circuit is formed, each component of which passes through one core of one discrete pair of cores, the yoke, the other core of that pair of cores, and the adjacent selected portion of the mold and the molten steel contained therein, so that when the coils are energized, the magnetic field extends from one wide face of the mold to the other. The local magnetic field in any one of the selected portions of the mold may be varied by varying the electrical currents passing through the pairs of coils associated with the pairs of magnetic field cores near that selected portion of the mold, so as to modify flow characteristics of molten steel exiting from the submerged entry nozzle into the casting mold. As each component magnetic circuit pole is provided with a discrete energizing coil, each pole pair may be energized independently of the other pole pairs, thereby providing control of the local magnetic field in the molten steel in the casting mold during casting.

In this further aspect of the invention each coil preferably energizes a portion of the core associated with at least one discrete finger having removable ferromagnetic and non-magnetic laminar elements. Note that the array of pole pairs and counterpart array of energizing coils may desirably correspond to the array of fingers, but need not do so.

The cores, including at least some of the removable ferromagnetic laminar elements, and the yoke should be made of iron or an alloy chiefly composed of iron. The removable non-magnetic laminar elements may be made of a heat resistant ceramic material. The ferromagnetic and non-magnetic laminar elements may be stackable rectangular parallelepiped plates, and they may be of varying heights and widths. If desired, some of the laminar elements may be dimensioned to span more than one finger.

BRIEF DESCRIPTION OF THE DRAWINGS

In the drawings, which illustrate embodiments of the invention.

DETAILED DESCRIPTION OF THE PREFERRED EMBODIMENTS

Figure 1:
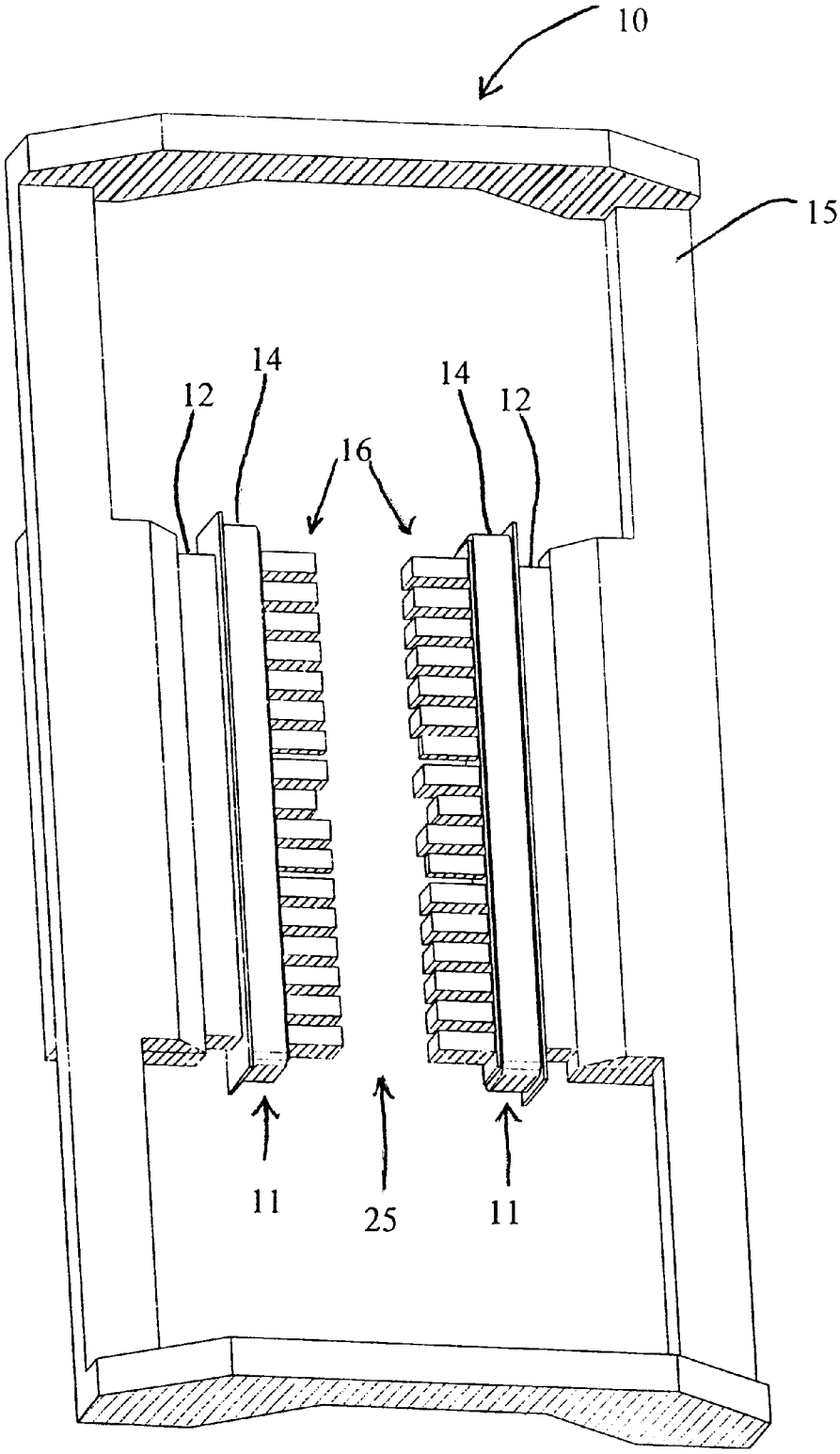
FIG. 1 is a schematic bottom isometric view of an apparatus suitable for embodying a magnetic brake in conformity with the present invention.

A magnetic field apparatus embodying the present invention is generally indicated by numeral 10 in FIG. 1. Apparatus 10 is comprised of two magnetic cores 12, each surrounded by a discrete coil 14. The cores 12 are connected together by a yoke 15 leaving a gap 25 for a casting mold (not shown in FIG. 1, but discussed below). In use, the casting mold and liquid steel in it complete a magnetic circuit including the yoke 15 and the cores 12.

On either side of the gap 25, the cores 12 are split into separate fingers, which are indicated generally by reference numeral 16. Ideally there would be no space between the fingers 16, and the fingers 16 would come into close proximity with the casting mold, so that with the mold in place receiving liquid steel, there would be two minimal gaps in the magnetic circuit.

Figure 2:
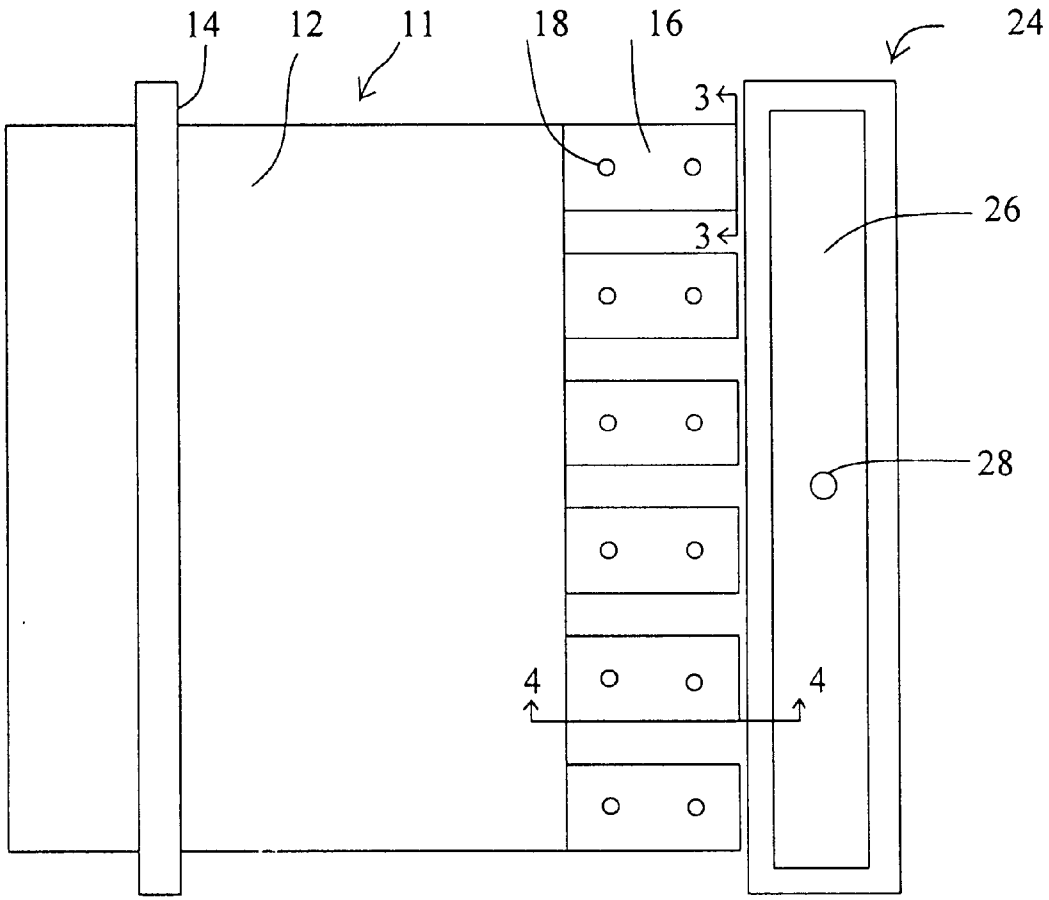
FIG. 2 is a simplified schematic plan view of one magnetic pole of the apparatus of FIG. 1 and an associated casting mold.

FIG. 1 illustrates a pair of discrete magnetic poles 11 each comprised of one core 12 surrounded by an associated coil 14 and ending in fingers 16. In FIG. 2, one of the magnetic poles 11 of the apparatus 10 is shown close to one wide face of a casting mold 24 having a mold cavity 26 and a submerged entry nozzle 28. The end of the magnetic core 12 close to the casting mold 24 is split into several protruding fingers 16 which are shown in further detail in FIGS. 3 and 4. As discussed above, the empty horizontal spacing between the fingers 16 could be eliminated where possible. The spacing is needed only when there are obstructions associated with the external water jacket and any other structural features (not shown) of the mold itself which must pass between the magnetic core 12 and the casting mold 24. One such possible structural feature is one or more strengthening ribs (not shown) that extend down the the wide faces of the mold. Such ribs can be accommodated by insetting the appropriate fingers relative to such ribs. By way of example, the centralmost pair of fingers is inset relative to the other fingers shown in FIG. 1. In FIG. 2, the schematically uniform spacing between the fingers 16 is shown for ease of illustration only.

The vertical position of the yoke relative to the mold is determined by the operator, taking into account factors such as the ferrostatic head of liquid steel above the submerged entry nozzle 28, the expected wear on the submerged entry nozzle 28, the size of the mold 26, and the chemical and physical properties of the steel.

Figure 3:
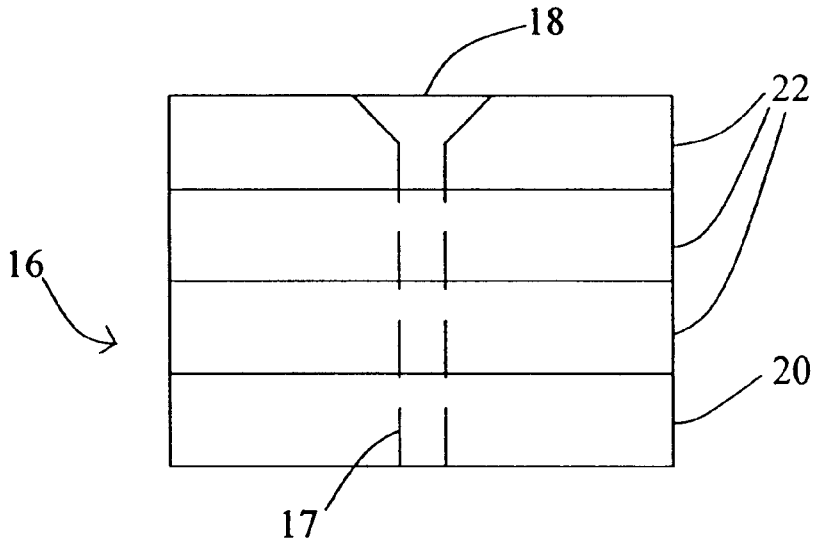
FIG. 3 is a schematic end elevation section view of a finger of the magnetic pole of FIG. 2. taken along the line 3—3 of FIG. 2, illustrating a vertically stackable series of removable plates (laminar elements) in conformity with one aspect of the invention.
Figure 4:
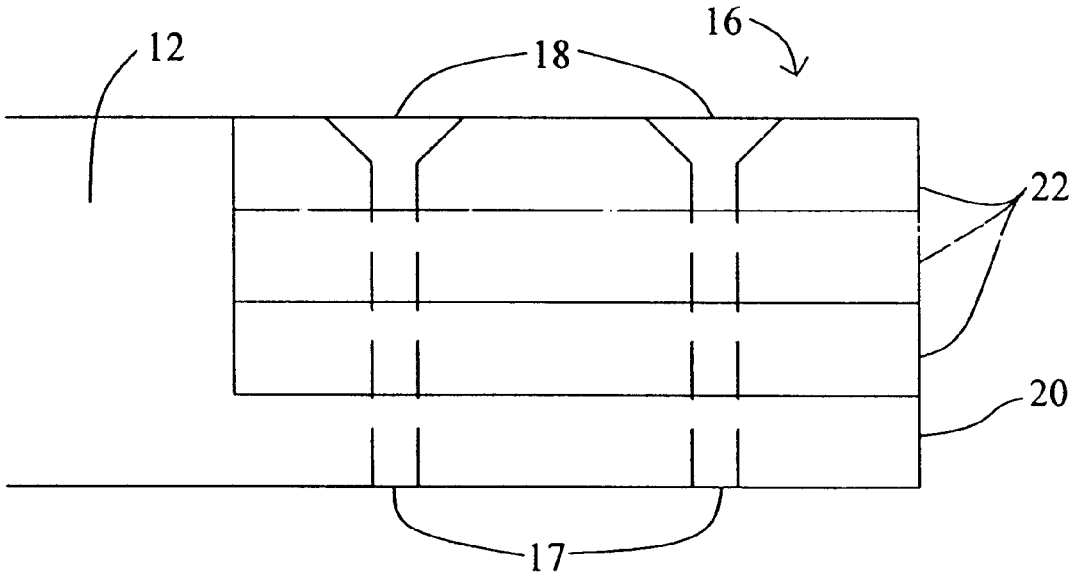
FIG. 4 is a schematic side elevation section view of a finger of the magnetic pole of FIG. 2 taken along the line 4—4 of FIG. 2, and illustrating the vertically stackable series of removable plates seen also in FIG. 3, in conformity with one aspect of the invention.

In the embodiment illustrated in FIGS. 3 and 4, each finger 16 has a fixed lowermost end piece 20 which is an extension of the magnetic core 12. Each fixed end piece 20 is provided with bores 17 threaded for receiving bolts 18. Removable upper end pieces (stackable laminar elements) ?2 in the form of relatively small rectangular parallelepiped plates made from ferromagnetic or non-magnetic material, three of which are illustrated by way of example but not by way of limitation, are secured to the fixed lower end piece 20 using bolts 18, so as to build up a laminated structure having a selected amount of magnetic material. The amount and position of magnetic material in a particular finger 16 directly affects the structure and strength of the magnetic field in the casting mold 24 in the vicinity of that finger 16; decreasing the amount of magnetic material by substituting non-magnetic stackable elements for ferromagnetic stackable elements decreases the magnetic field locally. Note that the magnetic field in the casting mold 24 may be quickly and easily varied by selecting the number, type (usually, ferromagnetic or non-magnetic), and position of removable upper end pieces 22 for each finger 16 (as well as the current flow through any associated coil; see the discussion of FIG. 7 below) to produce the desired flow pattern in the molten steel.

Figure 5:
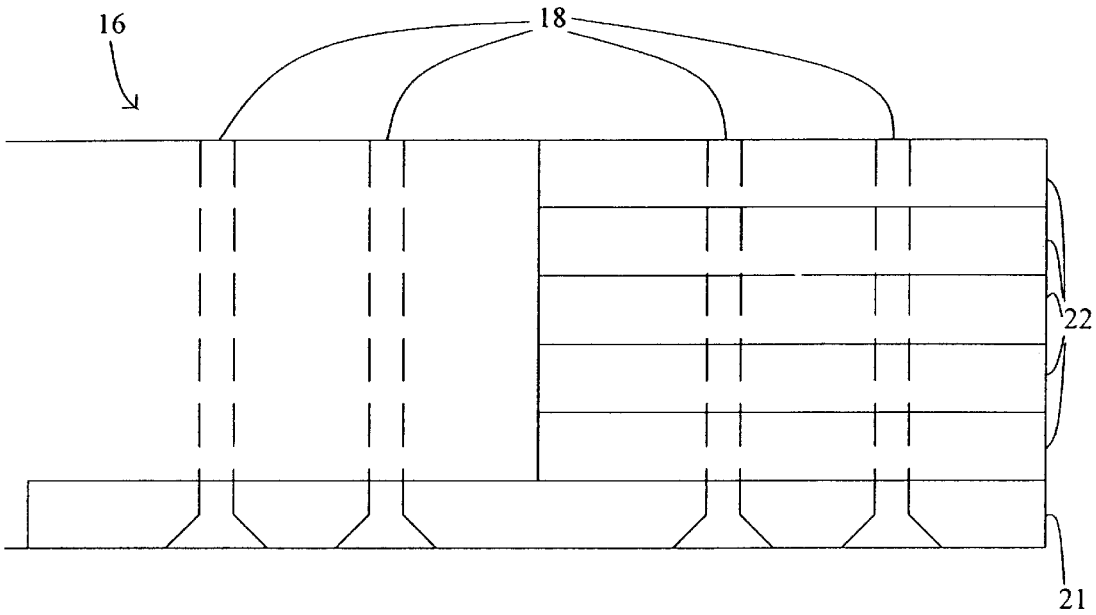
FIG. 5 is a schematic side elevation section view of a finger of the magnetic pole of FIG. 2 taken along the line 4—4 of FIG. 2, and illustrating an alternative embodiment of the vertically stackable series of removable plates wherein the fixed end piece of the illustrated finger is replaced by a removable end piece.

FIG. 5 shows an alternative embodiment of the structure of the finger 16 in FIGS. 3 and 4. A removable lower end piece 21 is provided in order to allow for the positioning of a non-magnetic end piece at the bottom of a stack. The removable lower end piece is provided with threaded bores 17 and attached to the core using bolts 18. Other bolts 18 are used to attach removable upper end pieces 22 to the removable lower end piece 21. The number of layers of removable upper end pieces 22 shown is merely an example, and should not be taken as a limitation of this embodiment.

Figure 6:
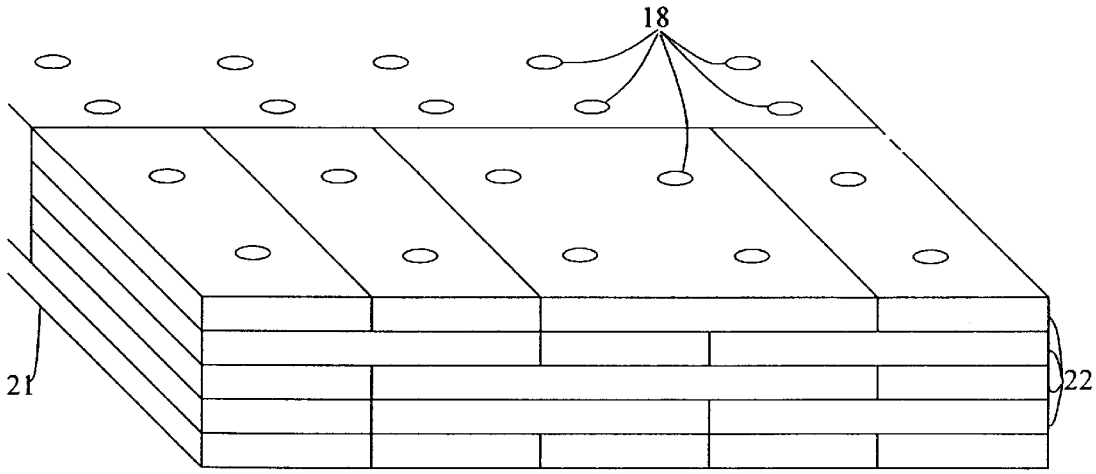
FIG. 6 is a schematic isometric view of one polar finger array of an embodiment of the present invention showing stackable laminar elements spanning more than one finger, in conformity with one aspect of the invention.

FIG. 6 illustrates how the removable end pieces (stackable laminar elements) 22 may span horizontally more than one finger 16. In places where it is desirable to have a strong magnetic field, the gaps between the fingers 16 may be eliminated entirely by the use of removable upper end pieces 22 which are two or more times the width of a finger 16. FIG. 6 shows this embodiment with removable lower end pieces 21, but fixed lower end pieces 20 could also be used. The bolts 18 holding the fingers 16 together are in the same position as in FIG. 5. The particular arrangement shown is for illustrative purposes only. The laminar elements 21, 22 may be made of materials with varying degrees of ferromagnetic properties, depending on the magnetic field requirements.

Figure 7:
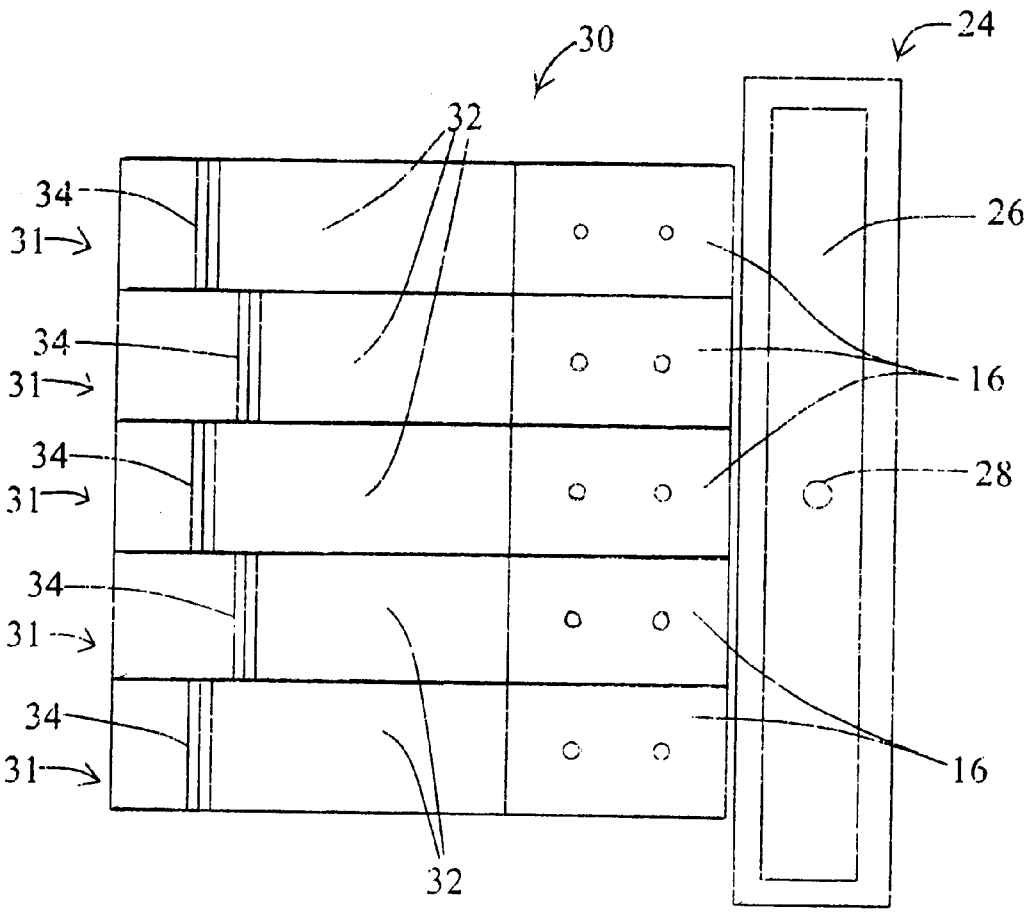
FIG. 7 is a schematic plan view of one polar array of a multipole variant of an apparatus embodying the present invention, illustrating the multiple energizing coil feature of one aspect of the invention.

Additional control over the magnetic field in a casting mold 24 may be achieved by use of more than one magnetic pole as illustrated in FIG. 7. Reference numeral 30 in FIG. 7 schematically indicates an exemplary five-pole system, each pole 31 terminating a core 32 (only one core of each pole pair is shown in FIG. 7). A discrete energizing coil 34 is associated with each core 32, and, in this illustration, one finger 16 per core 32. The coils 34 are arranged in a manner such that no two adjacent coils are at the same longitudinal position on the cores 32 so as to avoid physical interference between coils associated with adjacent cores and so as to maintain minimal spacing between adjacent cores. More than one finger 16 per pole 31 may be provided if necessary. FIG. 7 illustrates an idealized case in which there are no interfering obstructions. However, for even better control it may be advantageous to use more than one finger per pole (preferably with no spacing between fingers) even in the absence of obstructions. Each finger 16 preferably has the structure illustrated in one of FIGS. 3, 4 or 5 and described above for the single pole case, namely, a fixed or removable lower end piece 20 or 21 to which replaceable upper end pieces 22 may be bolted to build up a laminated structure having a selected amount of magnetic material and non-magnetic material in selected locations.

By independently controlling electrical current passing through the coils 34, the configuration of the magnetic field in the casting mold 24 may be controlled as casting proceeds. For example, a selected replaceable upper end piece 22 on a selected finger may have been removed or replaced to produce a particular magnetic field emanating from the pole associated with that finger when the current passing through the coils 34 is set at a selected set of values, but during casting, a somewhat weaker magnetic field associated with that finger may become advantageous. A weaker magnetic field from that finger may then be obtained without stopping the casting process by reducing the current to the associated energizing coil 34. The particular changes to be made in the various energization currents for all the coils 34 may be determined empirically, and may be expected to depend upon such factors as the type of steel being cast, the dimensions of the mold 24, the temperature distribution of the molten steel in the mold 24, and the rate and the temperature at which molten steel is flowing into the mold 24 through the submerged entry nozzle 28.

Figure 8:
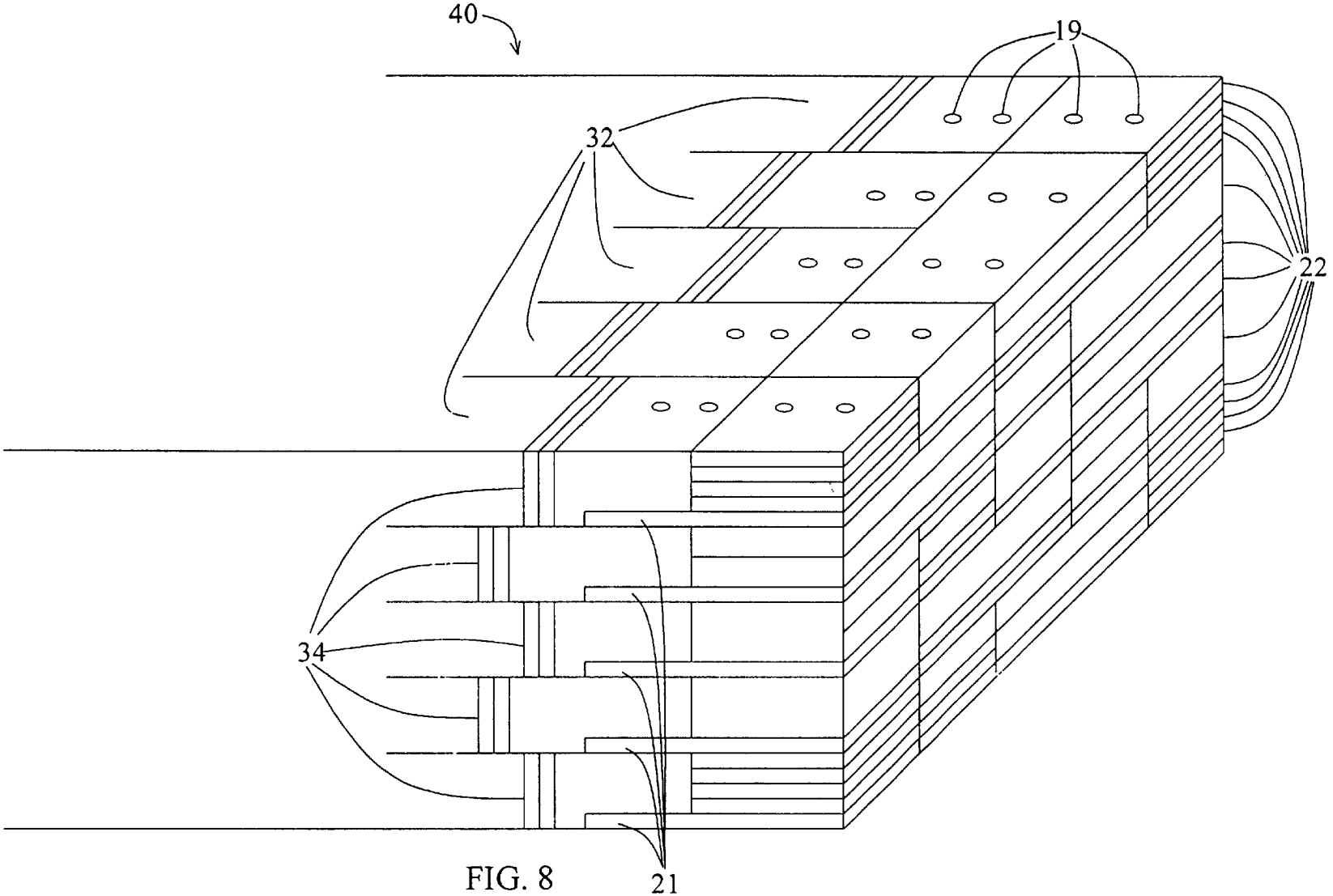
FIG. 8 is a schematic isometric view of a multipolar array of a partial embodiment of a magnetic brake according to an embodiment of the invention that combines options illustrated in preceding figures.

FIG. 8 shows an embodiment of the present invention in which the five-pole array 30 of FIG. 7 is expanded in the vertical direction, creating a two-dimensional matrix of fingers for greater control over the magnetic field distribution. The illustration shows five such five-pole arrays stacked vertically, resulting in a 25-pole matrix 40, each pole having one or more fingers. The coils 34 are arranged in a manner such that no two adjacent coils interfere with one another. Long bolts 19, which have a length approximately equal to the height of the 25-pole matrix 40, may be used in place of the shorter bolts 18 shown in previous illustrations. Removable lower end pieces 21 are shown by way of example only. The illustrated arrangement of the end pieces 21, 22 is merely one possible such arrangement, and is not intended to limit this embodiment of the invention.

While particular elements, embodiments and applications of the present invention have been shown and described, it will be understood, of course, that the invention is not limited thereto, since modifications may be made by those skilled in the applicable technologies, particularly in light of the foregoing description. The appended claims include within their ambit such modifications and variants of the exemplary embodiments of the invention described herein as would be apparent to those skilled in the applicable technologies.

What is claimed is:

1. An apparatus for providing a magnetic field in molten steel passing from a submerged entry nozzle into and through a generally vertically oriented mold for casting steel, the mold having a pair of opposed wide faces, the magnetic brake comprising cores terminating in opposed poles immediately adjacent selected portions of the wide faces of the mold and extending generally across the width thereof, the poles forming part of a magnetic circuit also including a yoke interconnecting the poles and the molten steel within the mold, the apparatus including electrical energizing coils about the cores or selected portions thereof for generating a magnetic field within the magnetic circuit;

the improvement characterized in that the faces of the poles are formed substantially as a generally horizontal array of discrete fingers, wherein each finger comprises:

(i) a lowermost projecting support upon which laminar elements may be vertically stacked; and (ii) a set of laminar elements mating with and complementing the projecting support and together with the support constituting a finger pole face, at least some of said laminar elements being removable and replaceable;

the magnetic properties of said laminar elements being selected for control of the magnetic field within the magnetic circuit.

2. Apparatus as defined in claim 1, wherein the laminar elements include selected elements made of ferromagnetic material.

3. Apparatus as defined in claim 2, wherein the laminar elements include selected elements made of non-magnetic material.

4. Apparatus as defined in claim 3, wherein the projecting support is made of ferromagnetic material.

5. An apparatus for providing a magnetic field in molten steel passing from a submerged entry nozzle into and through a generally vertically oriented mold for casting steel, the mold having a pair of opposed wide faces, comprising (a) a magnetic circuit including (i) cores terminating in opposed poles one on either side of the mold; the poles being located immediately adjacent selected portions of the wide faces of the mold and extending generally across the width thereof; the faces of the poles being formed substantially as a generally horizontal array of discrete fingers; at least selected ones of said fingers each comprising a stack of laminar elements; at least some of said laminar elements being removable and replaceable; and (ii) a yoke interconnecting the poles and molten steel within the mold;

(b) a plurality of energizing coils wound about the cores or selected portions thereof for generating a magnetic field in individual ones or selected groups of said fingers; and (c) respective energizing means for energizing individual ones or selected groups of said coils so as to enable energization of discrete said fingers or selected groups of said fingers.

6. Apparatus as defined in claim 5 wherein the coils and discrete portions of the cores are arrayed in a generally horizontal array.

7. Apparatus as defined in claim 5 wherein the coils correspond to the fingers in a one-to-one relationship.

8. Apparatus as defined in claim 5 wherein the coils and discrete portions of the cores are arrayed in a matrix array extending both horizontally across the width of the mold and vertically over a selected generally central portion of the mold.

9. Apparatus as defined in claim 8 wherein the coils correspond to the fingers in a one-to-one relationship.

10. Electromagnetic flow control apparatus in combination with a steel caster mold for use in a steel production facility, for influencing the flow of molten steel through the mold, comprising:

a) a mold having four walls forming a generally rectangular steel flow conduit cross-section, the walls comprising two broad walls and two narrow walls;

b) adjacent at least one said broad wall, electromagnetic apparatus for generating, when in operation, a magnetic field penetrating into molten steel within the mold; said electromagnetic apparatus:

i) including

A) a plurality of electrically conductive coil means for generating a corresponding plurality of local magnetic fields and configured so as to generate, when electric currents flow therethrough, said plurality of discrete local magnetic fields, at least some of which coil means are horizontally offset from one another; and B) means for supplying to each said coil means an adjustably variable electric current of magnitude selected to produce said local magnetic fields of sufficient strength to penetrate into molten steel passing through the mold;

ii) having a plurality of magnetic paths each associated with a discrete one of said local magnetic fields for carrying such associated local magnetic field through the adjacent mold wall and into molten steel passing through the mold; and iii) having means for individually varying the strength of each said electric current during a casting run thereby to vary the strength of the corresponding local magnetic field;

whereby the resultant magnetic field within steel flowing through the mold is the composite of the individual local magnetic fields, and the resultant magnetic field is controllably variable by means of controlled individual variation of the current that establishes at least one of the local magnetic fields.

11. The combination of claim 10, additionally comprising means for individually varying the strength of at least one said local magnetic field including means for varying a selected physical characteristic of the magnetic path associated with such local magnetic field.

12. The combination of claim 11, wherein the means for individually varying the strength of the local magnetic fields comprises means for individually varying the magnetic field strength of the magnetic path associated with each such local magnetic field.

13. The combination of claim 10, wherein, in operation, the electromagnetic apparatus produces a composite magnetic field in molten steel within the mold whose region of maximum concentration can be varied spatially within the mold relative to the broad wall of the mold adjacent the electromagnetic apparatus, by varying at least one of the individual local magnetic fields.

14. The combination of claim 10, wherein the electromagnetic apparatus is bifurcated with one portion thereof adjacent one of the broad walls of the mold and the other adjacent the other of the broad walls of the mold.

15. The combination of claim 10, including means for varying the current within each coil means during a casting run.

* * * * *